US006151784A

United States Patent [19]

Maruyama

[11] Patent Number: 6,151,784

[45] Date of Patent: Nov. 28, 2000

[54] ATTACHMENT FOR CONSTRUCTION MACHINE

[75] Inventor: Shingo Maruyama, Matsumoto, Japan

[73] Assignee: Izumi Products Company, Nagano, Japan

[21] Appl. No.: 09/166,852

[22] Filed: Oct. 6, 1998

[30] Foreign Application Priority Data

Feb. 25, 1998 [JP] Japan ..... 10-043249
May 15, 1998 [JP] Japan ..... 10-133314

[51] Int. Cl.[7] ..... B25F 3/00

[52] U.S. Cl. ..... 30/134; 83/928; 72/331; 173/192; 125/23.01

[58] Field of Search ..... 30/134, 131; 241/101.73; 83/928; 144/34.5; 72/331; 173/192; 125/23.01

[56] References Cited

U.S. PATENT DOCUMENTS

| | | | |
|---|---|---|---|
| 3,889,762 | 6/1975 | Sumner | 173/139 |
| 3,980,341 | 9/1976 | Musannif et al. | 299/36 |
| 4,584,442 | 4/1986 | Shields et al. | 191/12.2 |
| 4,602,821 | 7/1986 | Schaeff | 299/67 |
| 4,616,417 | 10/1986 | Gross | 30/134 |
| 4,961,543 | 10/1990 | Sakato et al. | 241/266 |
| 5,137,096 | 8/1992 | Druesdow | 173/171 |
| 5,174,387 | 12/1992 | Arndt et al. | 173/1 |
| 5,644,178 | 7/1997 | Halm | 301/43 |
| 5,664,734 | 9/1997 | Terada et al. | 241/266 |
| 5,671,892 | 9/1997 | Morikawa et al. | 241/101.73 |
| 5,689,905 | 11/1997 | Ibusuki | 37/403 |
| 5,860,214 | 1/1999 | Morikawa et al. | 30/134 |
| 5,894,666 | 4/1999 | Hrusch | 30/134 |
| 5,926,958 | 7/1999 | Ramun | 30/134 |

FOREIGN PATENT DOCUMENTS

| | | |
|---|---|---|
| 1-44270 | 12/1989 | Japan . |
| 4-112729 | 9/1992 | Japan . |
| 7-11851 | 3/1995 | Japan . |

*Primary Examiner*—Lee Young
*Attorney, Agent, or Firm*—Liniak, Berenato, Longacre & White

[57] ABSTRACT

An attachment for a construction machine is disclosed The attachment includes: a frame body; a first frame member attached to the frame body; a second frame member attached to the frame body in opposing relation with the first frame member. The first frame member and the second frame member are provided at the respective opposing inner surfaces with cutting means and crushing means. The first frame member and/or the second frame member are(is) movable toward each other for the engagement therewith. The first frame member or the second frame member is further provided with a hydraulic breaker having a chisel.

15 Claims, 17 Drawing Sheets

(X-X)
10
15
13'
14
17
16
δ

15
10
15
13'
X
X
15
15
15
17
30'
17
14
17
16
17

ATTACHMENT FOR CONSTRUCTION MACHINE

BACKGROUND OF THE INVENTION

1. Field of the Invention

The present invention relates to an attachment or work implement for a construction machine used to demolish a construction such as a building, and more particularly relates to an attachment attached to the front end of a boom-type arm assembly of a construction machine so as to ensure multifunctional operations such as cutting, breaking and drilling.

2. Prior art

A known attachment or work implement 150 for a construction machine is shown in FIG. 15. This attachment is in the type of a crusher having cutters and is used to demolish a construction such as a building.

The attachment 150 includes a flame body 151 to which is connected a movable member 152 and a stationary member 153. Within the flame body 151, there is provided a hydraulic cylinder to open and close the movable member 152 with respect to the stationary member 153.

The movable member 152 and the stationary member 153 are provided at the respective opposing inner surfaces with a cutter 154, 155 for a cutting operation, and at the respective front ends of the inner surfaces with an inwardly projecting crushing claw 156, 157 for a crushing operation.

As shown in FIG. 16, the attachment 150 is attached to a construction machine 1 for example a drag shovel at the front end of its boom-type arm assembly 2. The attachment 150 is actuated by hydraulic oil from a power unit 3.

However, when demolishing or breaking a construction with the use of this attachment 150, it is necessary to drill bore holes in concrete walls of the building for insertion of the crushing claw(s) 156, 157. For this reason, another non-shown construction machine provided with a breaker is employed, or alternatively the attachment 150 is replaced with another attachment (not shown) provided with a breaker 160 (FIG. 17) for the drilling operation. When the drilling operation is completed, the construction machine 1 is then carried into the demolition site, or the attachment with the breaker is again replaced with the attachment 150. Upon demolishing the construction, the crushing claw(s) 156, 157 of the attachment 150 is(are) inserted into the bore holes, thereby applying demolition pressure. The cutters 154, 155 are used to cut concrete walls and reinforcing steels.

SUMMARY OF THE INVENTION

As mentioned above, since the attachment 150 of the construction machine 1 is not provided with a breaker, another construction machine is required for drilling bore holes in the concrete walls of the construction. However, provision of two construction machines is costly, and further, if the demolition site is in an urban area, crowded with buildings or houses, installation space for the construction machines will be restricted.

If one construction machine is used and the attachment 150 is attached in place of the attachment provided with the breaker (FIG. 17) after the drilling operation is completed, it is more cost effective. However, replacement of the attachment 150 is time-consuming, leading to decreased operating efficiency of the construction machine.

In such attachment 150, there is also a demand on further operations, such as breaking the thus demolished concrete blocks into large or small cants.

In view of the above, the present invention seeks to provide an attachment for a construction machine, which is space and cost saving and is excellent in its operating efficiency.

According to the present invention, there is provided an attachment for a construction machine including:

a frame body;

a first frame member attached to the frame body;

a second frame member attached to the frame body in opposing relation with the first frame member;

cutting means mounted on the respective opposing inner surfaces of the first and the second frame members; and crushing means provided on the first and the second frame members at the respective front ends of the opposing inner surfaces, the first frame member and/or the second frame member being movable toward each other for the engagement therewith, characterized in that either said first frame member or said second frame member is provided with a hydraulic breaker having a chisel.

Other objects and features of the present invention will become apparent by reference to the following detailed description taken in conjunction with the accompanying drawings.

DESCRIPTION OF THE PREFERRED EMBODIMENT

Figure 1:
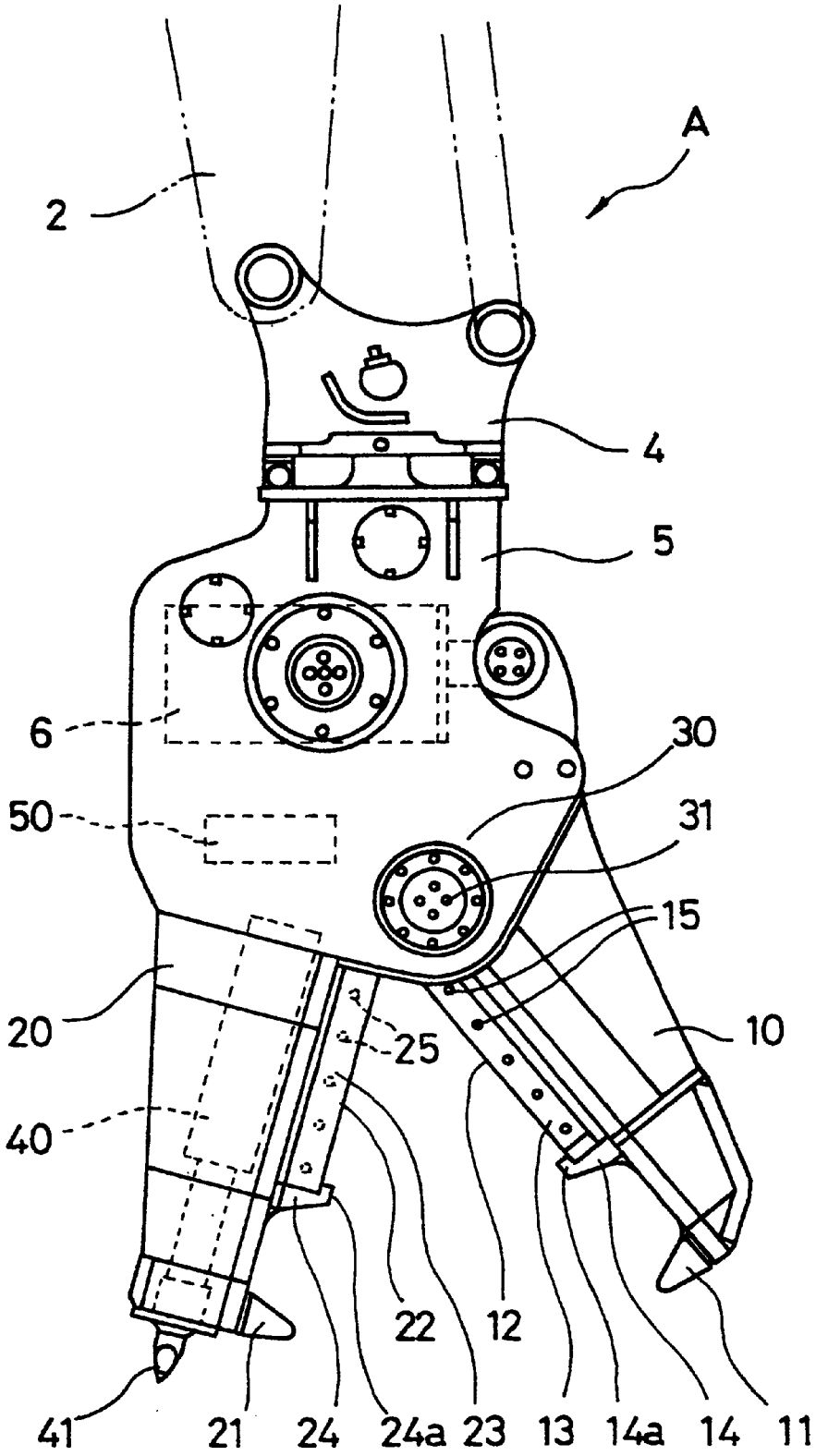
FIG. 1 is a side view of an attachment for a construction machine according to the present invention.

Referring now to FIG. 1, an attachment A of the present invention is attached to a construction machine at the front end of its boom-type arm assembly 2 through a top bracket 4, which is pivotally supported at the front end of the arm assembly 2. The attachment A includes a frame body 5 rotatably connected to the top bracket 4, a movable member 10 rotatably supported to the frame body 5 and a stationary member 20 fixed to the frame body 5 in opposing relation with the movable member 10. Each of the members 10 and 20 is provided intermediately of the respective opposing inner surface with a cutter 12, 22 for a cutting operation, and at the front end of the respective opposing inner surface with a crushing claw 11, 21 for a breaking operation. The stationary member 20 is further provided with a hydraulic breaker 40 for a drilling operation. The hydraulic breaker 40 includes a chisel 41, which is outwardly extending from the front end of the stationary member 20.

Each cutter 12, 22 includes a cutting blade 13, 23, which is fixed to a cutter holder 14, 24 protruding from the inner surface of each member 10, 20 with the use of a plurality of bolts 15, . . . and 25 . . . The cutting blade 13 having a square profile is substantially the same as the cutting blades 23. The cutting blades 13 and 23 engage with each other by the closing movement of the movable member 10 toward the stationary member 20. Each of the cutter holders 14, 24 has the front end portion 14*a*, 24*a*, the height of which is taller than that of the cutting blade 13, 23, thereby providing a stopper preventing an object to be cut from displacing out of the cutting region between the two cutting blades 13, 23.

Figure 2:
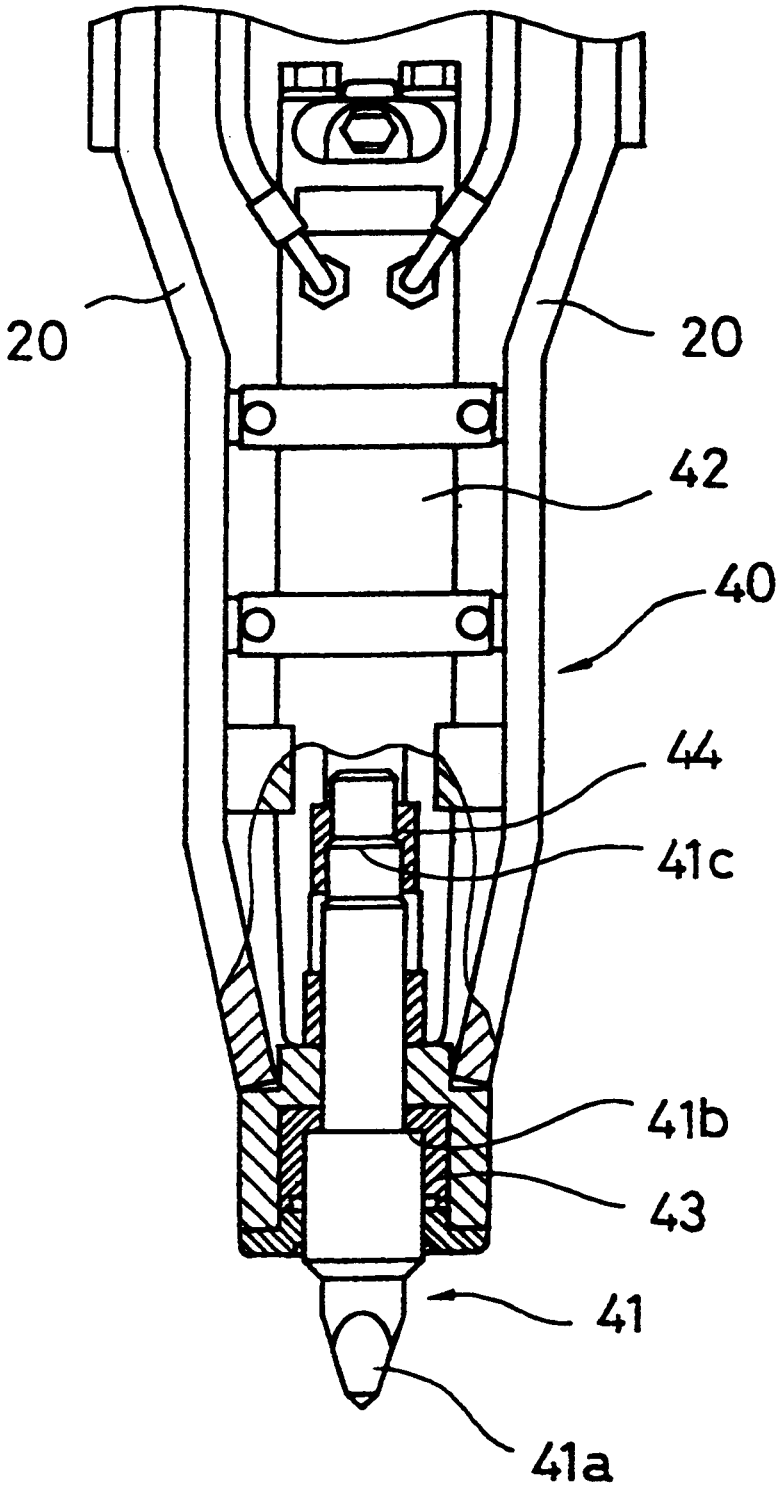
FIG. 2 is a plan view partially in cross section of a hydraulic breaker provided within the attachment shown in FIG. 1.

As shown in FIG. 2, the hydraulic breaker 40 is mounted within the stationary member 20. The hydraulic breaker 40 has the breaker body 42 within the stationary member 20 and the chisel 41 positioned at the front end of the stationary member 20. Since the hydraulic breaker 40 is mounted within the limited space of the stationary frame 20 and the size and the capacity thereof are small, the hydraulic breaker 40 may be overloaded by hydraulic oil from the construction machine 1 flown beyond the capacity thereof. In order to prevent malfunction of the hydraulic breaker 40 due to the hydraulic pressure difference, there is provided a hydraulic power control unit 50 to be described in detail later.

As shown in FIG. 2, the front end portion 41*a* of the chisel 41 is formed as a sharp inverted pyramid and is extending outwardly from the stationary member 20. When drilling bore holes in a concrete structure, the front end portion 41*a* of the chisel 41 is subject to enormous reaction force or impact, and hence the chisel 41 may suffer from breakage at its stem portion. For this reason, the stem of the chisel 41 is provided with a plurality of stepped portions, such as a first stepped shoulder 41*b* adjacent to the front end portion 41*a* and a second stepped shoulder 41*c* provided at the other end remote from the front end portion 41*a*. The first stepped shoulder 41*b* and the second stepped shoulder 41*c* are supported respectively by a chisel bushing 43 attached to the front end of the stationary member 20 and a shank bushing 44 within the stationary member 20. With the provision of the two stepped shoulders 41*b* and 41*c*, reactive force or impact exerted on the chisel 41 is divided and absorbed at the respective stepped shoulders 41*b*, 41*c*. Further, since the first stepped shoulder 41*b* is adjacent to the front end portion 41*a* of the chisel 41, breakage of the chisel 41 due to vibration or displacement perpendicular-to the axis of the chisel 41 can be prevented.

Figure 16:
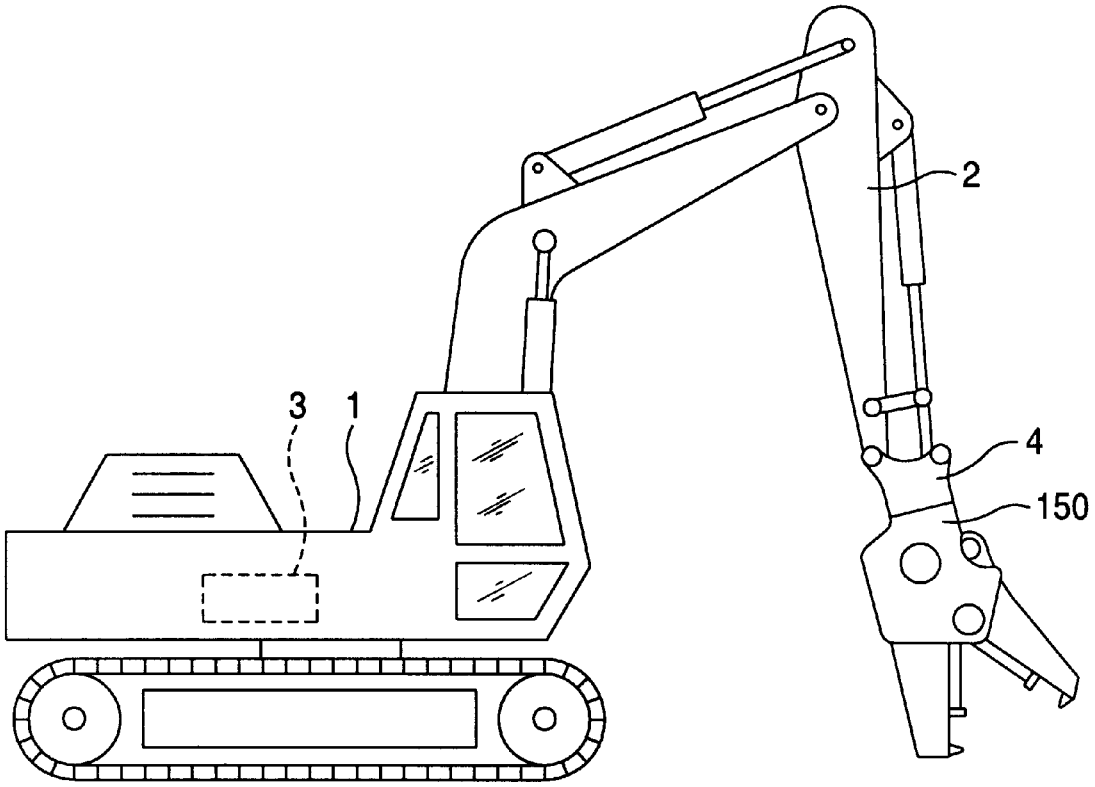
Fig. 16 Prior Art
FIG. 16 is a side view showing the attachment of FIG. 15 attached to a construction machine.
Figure 17:
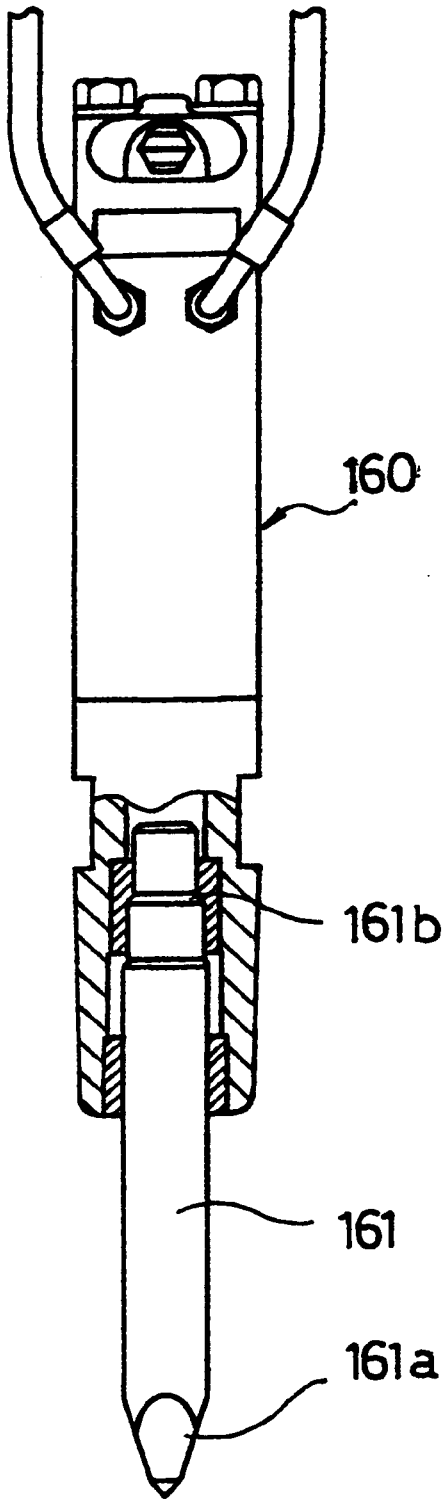
FIG. 17 is a plan view of a known hydraulic breaker.

When actuating the movable member 10 or the hydraulic breaker 40, hydraulic oil is flown from a hydraulic power unit 3 of the construction machine 1, such as shown in FIG. 16. However, if the hydraulic oil is directly flown into the breaker 40 for actuating the movable member 10, the breaker 40 may be overloaded due to the oil flown beyond the capacity of the breaker 40. For this reason, as shown in FIG. 1, a hydraulic power control unit 50 is provided within the frame body 5 for adjusting hydraulic pressure within the hydraulic circuit.

Figure 3:
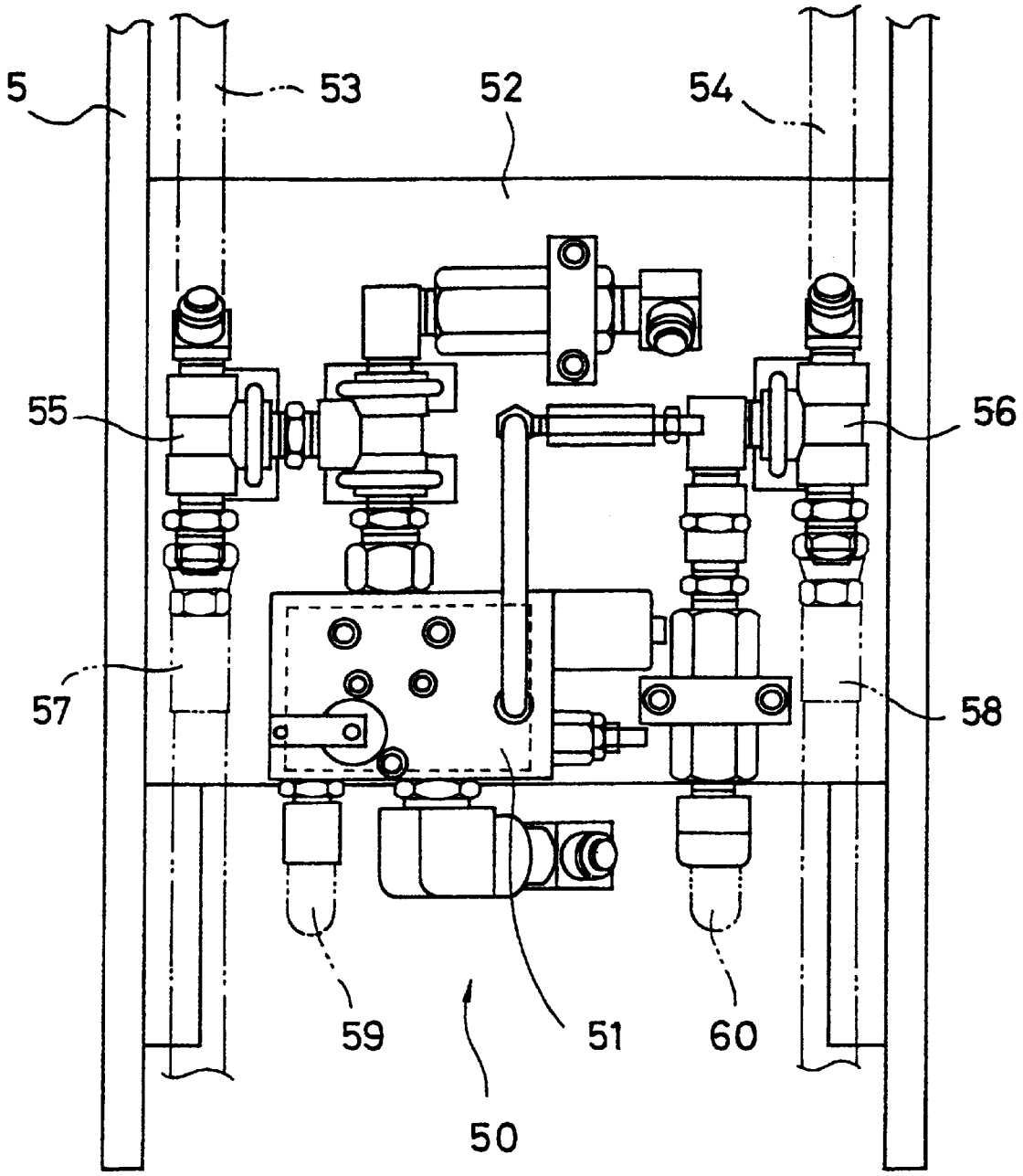
FIG. 3 is a plan view of a hydraulic power control unit of the attachment shown in FIG. 1.

As best shown in FIG. 3, the hydraulic power control unit 50 includes a priority valve 51 mounted on a mounting frame 52 and hose joints 55, 56. The priority valve 51 is used for applying hydraulic pressure to a particular circuit in a hydraulic system prior to the other circuits. A hydraulic hose 53 and a hydraulic hose 57 are connected at the respective inlet and outlet sides of the hose joint 55, while a hydraulic hose 54 and a hydraulic hose 58 are connected at the respective inlet and outlet sides of the hose joint 56. The hydraulic hoses 53 and 54 are connected at their opposite ends to the hydraulic power unit 3 of the construction machine 1 through a swivel joint 70 to be described in detail later. The hydraulic hoses 57 and 58 are connected at their opposite ends to a hydraulic cylinder 6 for actuating the movable member 10 of the attachment A The priority valve 51 is connected at the outlet side of the hose joint 55 for actuating the hydraulic breaker 40. The hydraulic breaker 40 is connected at the inlet side to a hydraulic hose 59 and at the outlet side to a hydraulic hose 60. The hydraulic hose 59 is connected at the opposite end to the priority valve 51 so that the hydraulic oil flown into the hose 59 is controlled by the priority valve 51. The hydraulic hose 60 is connected at the opposite end to the outlet side of the hose joint 56 so that the hydraulic oil from the priority valve 51 is flown back to the hydraulic power unit 3 through the hydraulic hose 54.

Figure 4:
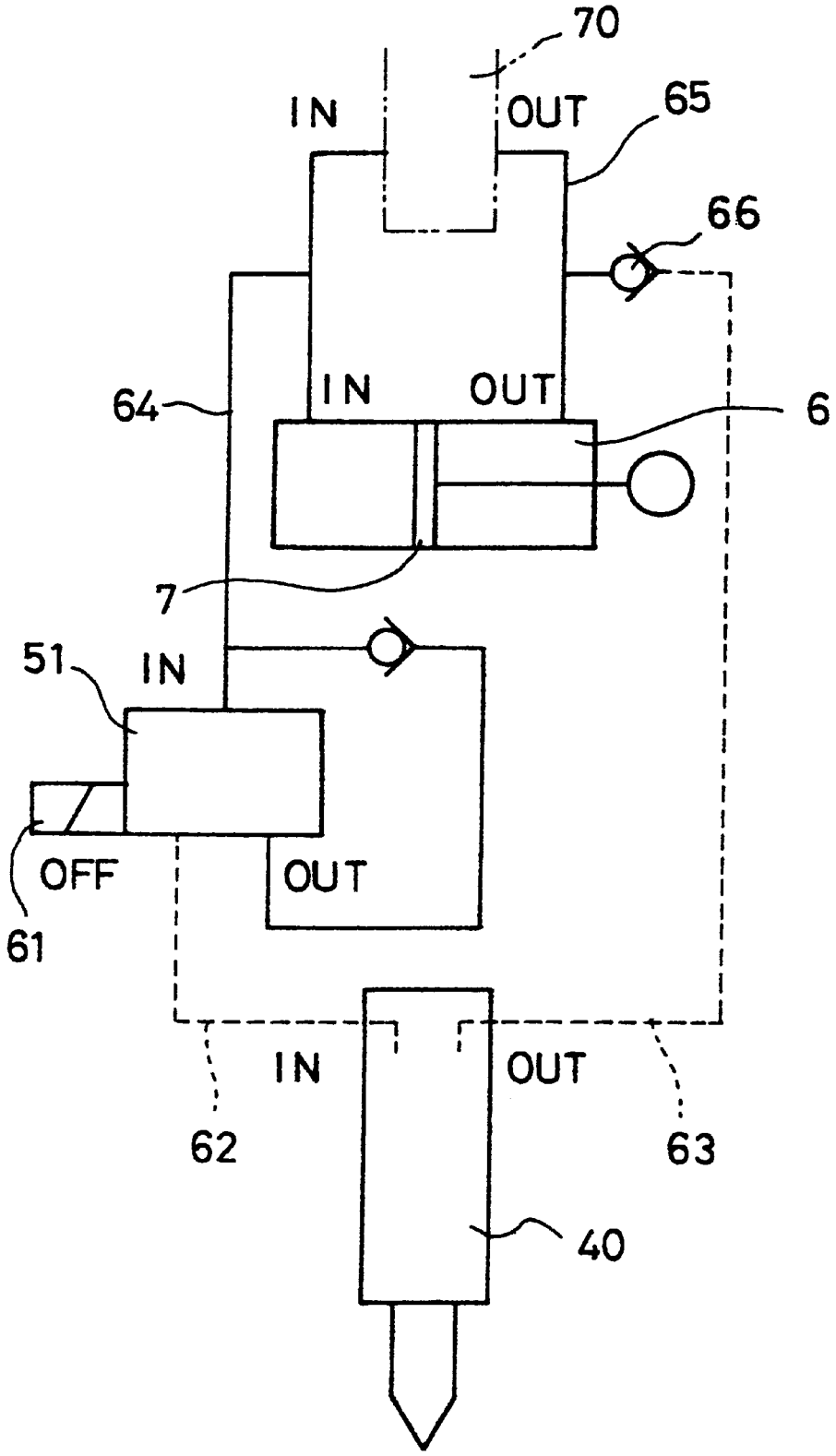
FIG. 4 shows a hydraulic circuit of the hydraulic power control unit shown in FIG. 3.

Operation of the hydraulic power control unit 50 will be described. As shown in FIG. 4, when the hydraulic breaker 40 is not used, a hydraulic beaker switch (not shown) at the driver's seat is turned to the off-position and a solenoid 61 of the priority valve 51 is off. In such position of the hydraulic breaker switch, the hydraulic circuit 62 communicating with the hydraulic breaker 40 is closed and hydraulic oil from the hydraulic power unit 3 is not flown into the breaker 40, therefore the breaker 40 is not actuated. Meanwhile, hydraulic oil from the hydraulic power unit 3 is flown through the swivel joint 70 into the hydraulic cylinder 6, thereby actuating the movable member 10.

Figure 5:
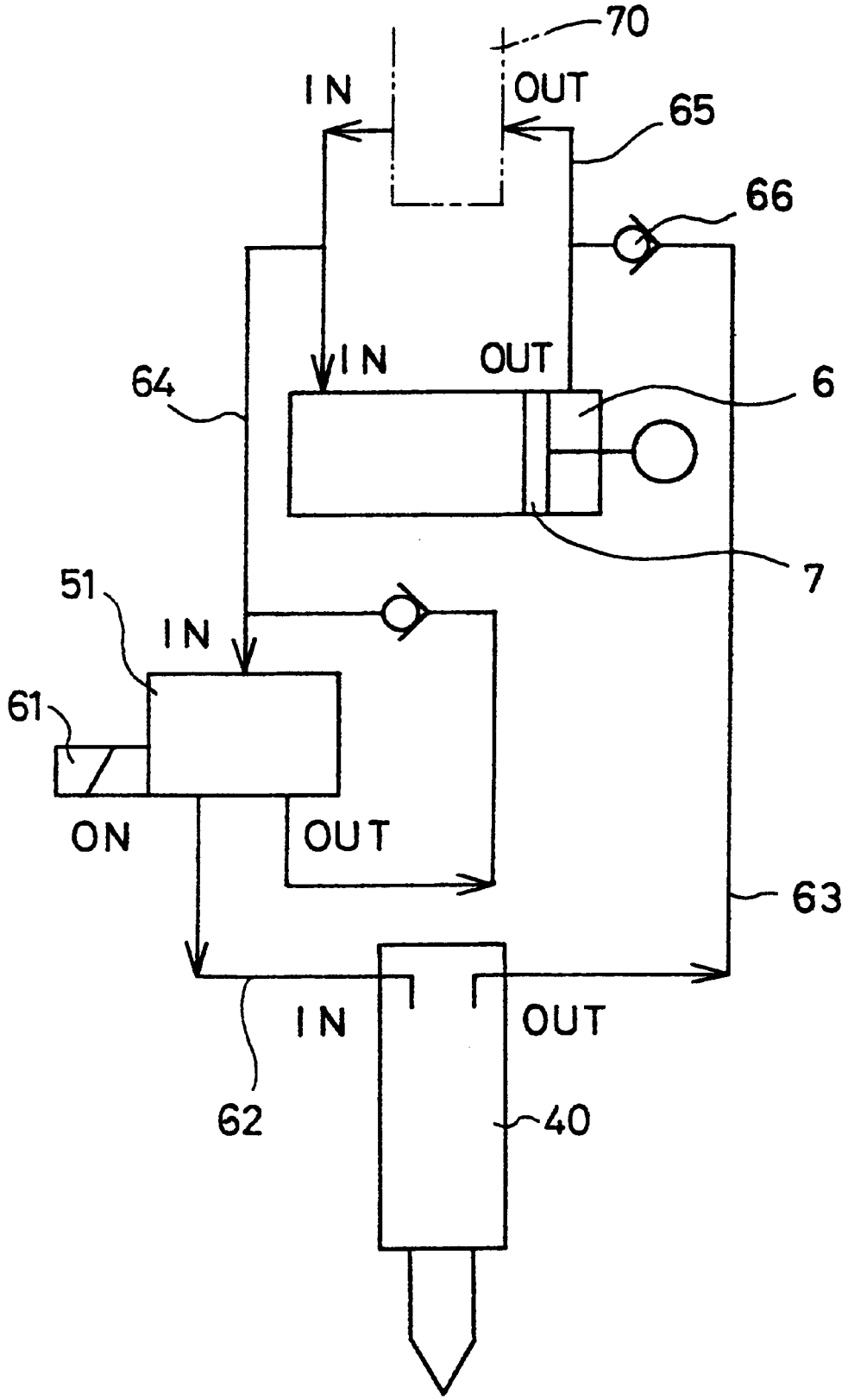
FIG. 5 shows the hydraulic circuit of the hydraulic power control unit shown in FIG. 3.

As shown in FIG. 5, when actuating the hydraulic breaker 40, the hydraulic breaker switch (not shown) at the driver's seat is turned to the on-position and the solenoid 61 of the priority valve 51 is on. In such position of the hydraulic breaker switch, the hydraulic circuit 62 is open and hydraulic oil from the hydraulic power unit 3 is flown into the hydraulic breaker 40, thereby actuating the breaker 40. The hydraulic pressure applied to the hydraulic breaker 40 is controlled at the priority valve 51 to be less than ⅕ compared to the hydraulic pressure within the hydraulic oil passage 64 connected with the priority valve 51. With the provision of the priority valve 51, the hydraulic breaker 40 is not overloaded due to the hydraulic oil flown beyond its capacity, and therefore breakage of the breaker can be prevented.

Hydraulic oil supplied to and actuating the hydraulic breaker 40 is returned from an oil passage 63 provided with a check valve 66 to an oil passage 65 between the swivel joint 70 and the outlet side of the hydraulic cylinder 6. When the hydraulic oil passage 65 is closed, hydraulic oil may be flown back to the hydraulic cylinder 6. However, since the hydraulic pressure at the inlet side of the hydraulic cylinder 6 is sufficiently large, the piston 7 of the hydraulic cylinder 6 is not affected by the counterflow of the hydraulic oil flown into the hydraulic cylinder 6.

With the provision of the hydraulic power control unit 50, the hydraulic power unit 3 can be used to actuate both the hydraulic cylinder 6 and the hydraulic breaker 40 regardless of the difference between their capacities. Therefore, a separate low-power hydraulic power unit is not required for the hydraulic breaker, leading to reduced cost of the construction machine 1.

Figure 6:
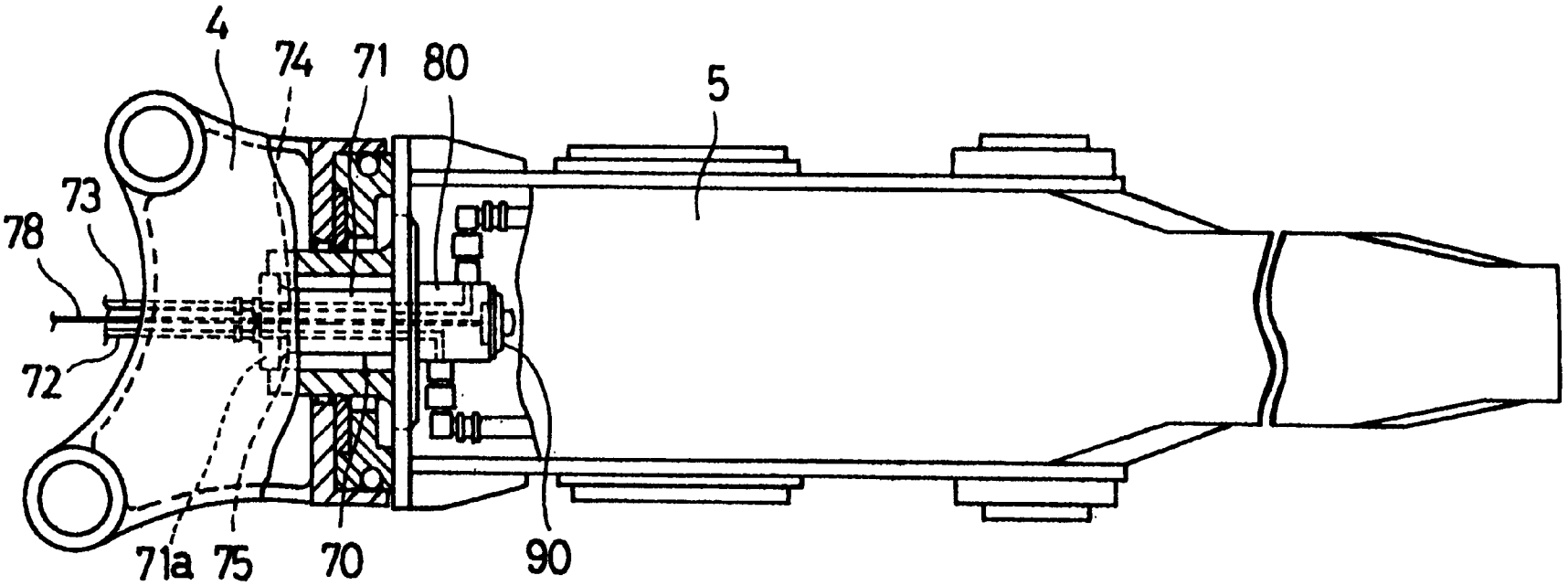
FIG. 6 is a plan view partially in cross section of a swivel joint mounted on the attachment shown in FIG. 1.

The construction of the swivel joint 70 will now be described with reference to FIGS. 6 and 7.

The swivel joint 70 is used to rotatably connect the top bracket 4 and the frame body 5. As shown in FIG. 6, the swivel joint 70 comprises a swivel piston 71 fixed to the top bracket 4, a swivel ring 80 rotatable with respect to the swivel piston 71 and a front rotational portion 90 attached to the top end of the swivel ring 80.

The swivel piston 71 has a base portion 71*a* to which is connected hydraulic hoses 72 and 73 from the hydraulic power unit 3. The hydraulic hoses 72, 73 are respectively connected to the oil passages 74 and 75 through connectors. The oil passages 74, 75 are provided within the base portion 71*a* and are in communication with oil grooves 76, 77 at the front periphery of the swivel piston 71.

The swivel piston 71 has the inner tubular portion 71*b* through which an electric cable 78 extends. The electric cable 78 is for actuating the solenoid 61 of the priority valve 5. The electric cable 78 is connected at one end to the battery of the construction machine 1. The other end of the cable 78 is connected through the front rotational portion 90 (hereinafter described) to a connecting cable 89 fixed to the swivel ring 80. The connecting cable 89 is fixed to the outer periphery of the swivel ring 80 by a fixing member (not shown) so as to be rotatable with the swivel ring 80.

Figure 7:
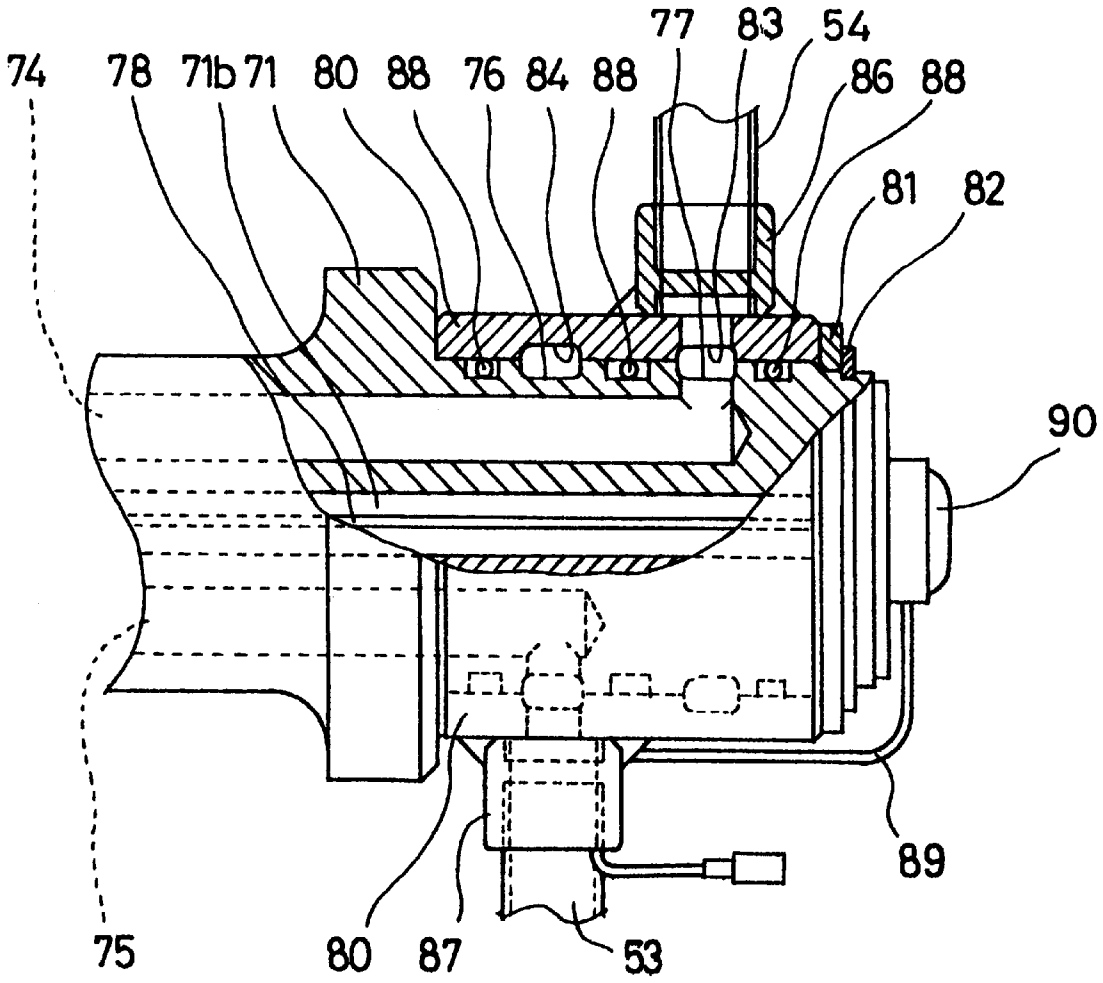
FIG. 7 is an enlarged sectional view of the swivel joint shown in FIG. 6.

As shown in FIG. 7, the swivel ring 80 is rotatably mounted on the front periphery of the swivel piston 71 by a swivel washer 81 and a retaining ring 82. Provided at the inner peripheral surface of the swivel ring 80 are oil grooves 83, 84 which mate with the oil grooves 76, 77 so as to form the closing oil passages. The oil grooves 83, 84 are connected with the hydraulic hoses 53, 54 from the priority valve 51 through connectors 86, 87.

The outer periphery of the swivel piston 71 is provided with three circular grooves, in which are fitted corresponding three O-rings 88, 88, 88, thereby sealing the oil grooves 83, 84. By such arrangement of the swivel joint 70, the swivel ring 80 becomes rotatable with respect to the swivel piston 71. Hydraulic oil from the hydraulic power unit 3 is constantly supplied irrespective of the position of the swivel ring 80.

Figure 8:
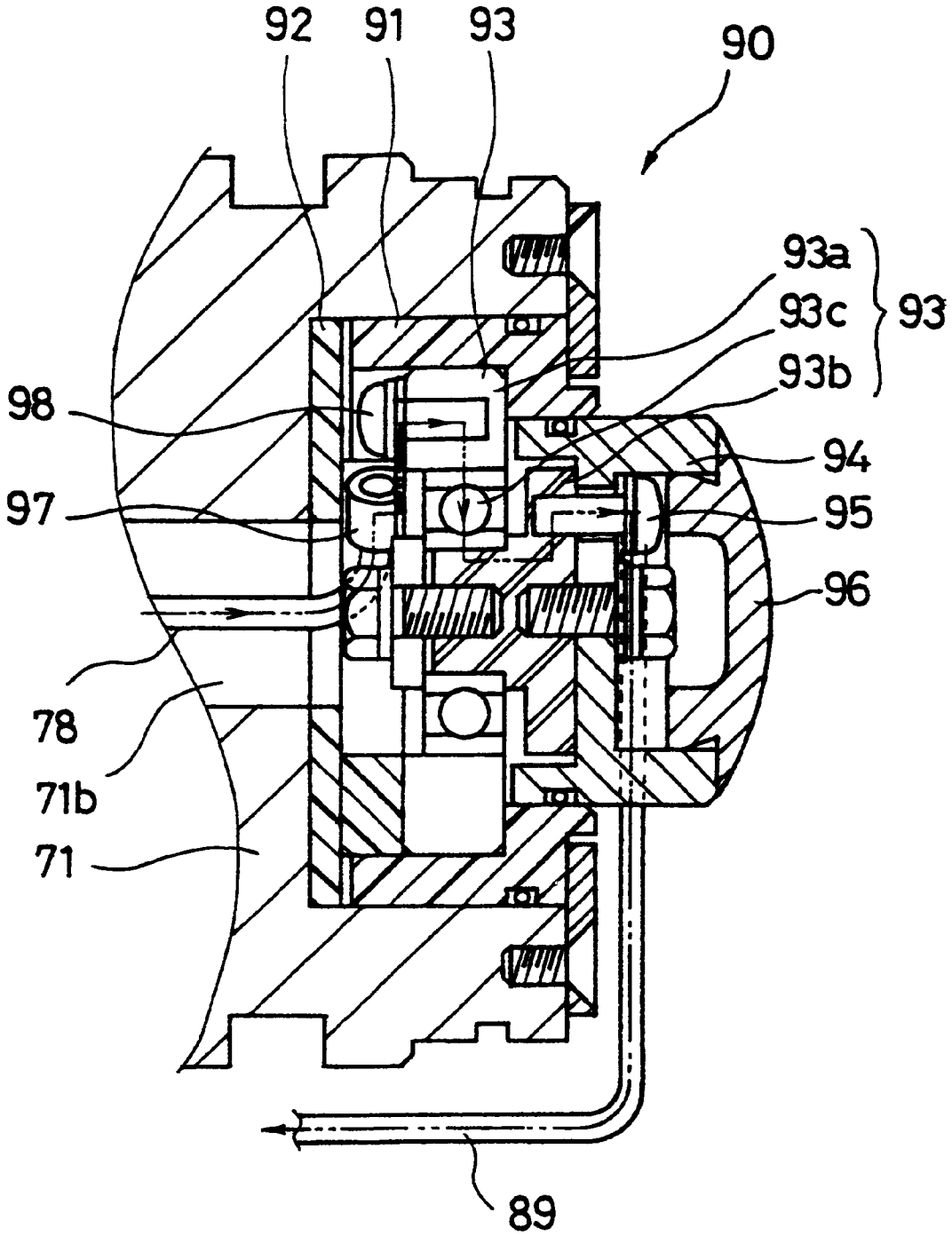
FIG. 8 is an enlarged sectional view of the swivel joint shown in FIG. 6, particularly showing the front rotational portion thereof

The front rotational portion 90 attached to the front end of the swivel piston 71 is for electrically connecting the electric cable 78 and the connecting cable 89. The front rotational portion 90 is electrically insulated from the swivel piston 71. As shown in FIG. 8, the front end of the swivel piston 71 is provided with the inner insulated region separated by an insulating bush 91 and an insulating spacer 92. An electrically conducting bearing 93 is positioned within the inner insulated region. The electrically conducting bearing 93 comprises a ball bearing 93*c*, a bearing collar 93*a* within the insulating bush 91 for supporting the ball bearing 93*c* and a bearing shaft 93*b* rotatably supported by the ball bearing 93*c*. An insulating cover 94 is fixed to the bearing shaft 93*b* by a screw 95. The connecting cable 89 is connected to the screw 95 by a non-shown bare crimp contact. A rubber plug 96 is fitted within the insulating cover 94.

The front rotational portion 90 is electrically connected to the electric cable 78 through a screw 98. The front end of the electric cable 78 is connected to the screw 98 through a bare crimp contact 97. The screw 98 is then mounted on the bearing collar 93*a*. Since the bearing collar 93*a*, the bearing shaft 93*b* and the ball bearing 93*c* are made of metal, the electric cable 78 is electrically connected to the connecting cable 89. To ensure reliable electrical conductivity, the electrically conducting bearing 93 employs conductive grease in stead of lubricating grease. An electrical current through the electric cable 78 flows from the bare crimp contact 97 and the screw 98 through the electrically conducting bearing 93 (the bearing collar 93*a*, the ball bearing 93*c* and the bearing shaft 93*b*) to the screw 95, and from the screw 95 through the non-shown bare crimp contact to the connecting cable 89 (referring to the arrow in FIG. 8).

Since the front rotational portion 90 is electrically insulated from the swivel piston 71 and the outer construction, it is not suffer from short circuit and electrical leakage. The swivel joint 70 is therefore reliable in its electrical performance as well as its operational performance.

Figure 9:
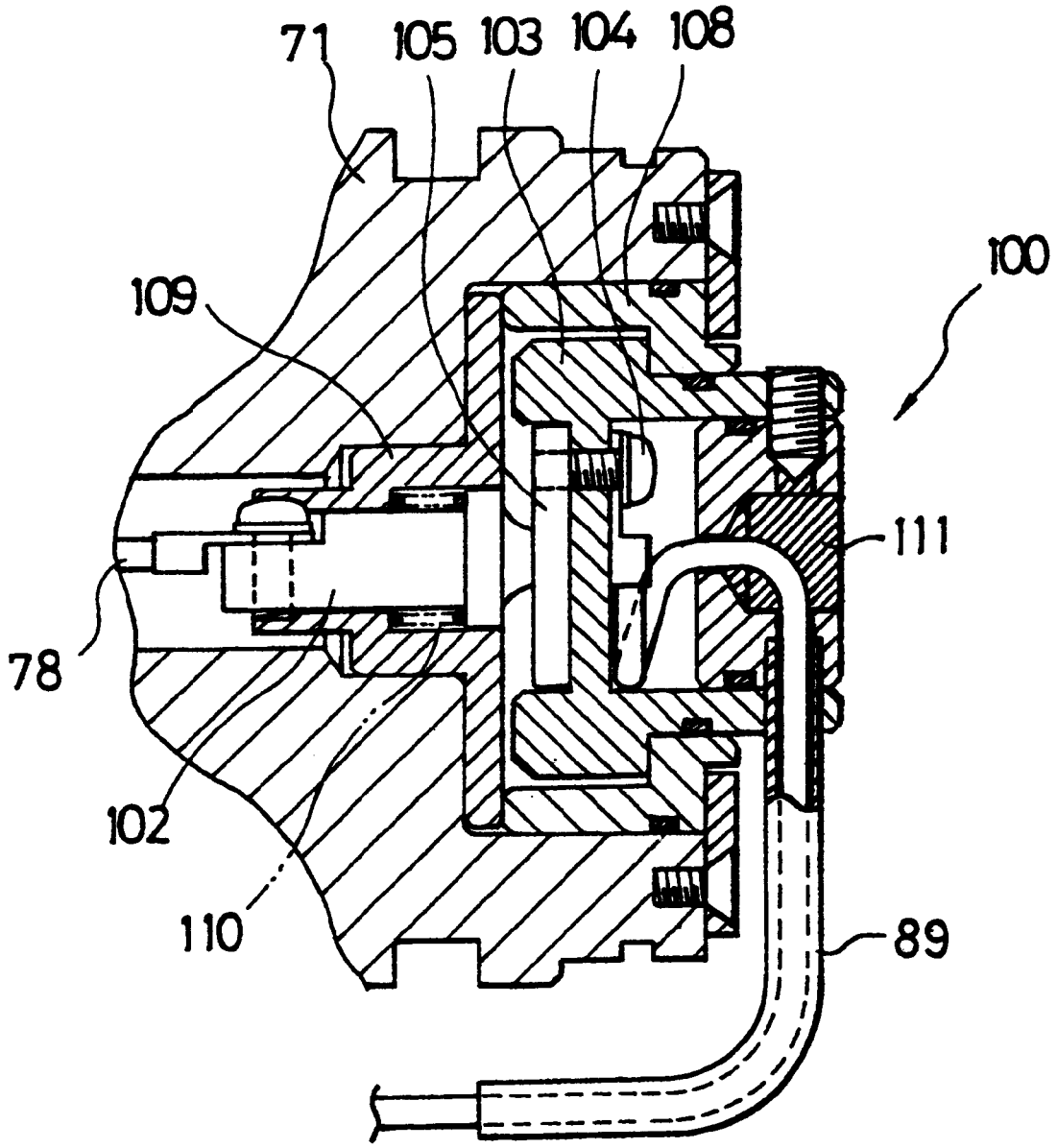
FIG. 9 is an enlarged sectional view showing a modified front rotational portion of the swivel joint.

Referring to FIG. 9, a modified swivel joint is depicted, in which the front rotational portion 100 comprises an electrically conducting member 102 and an electrically conducting washer 105. The electric cable 78 through the swivel piston 71 is connected at the front end with the electrically conducting member 102. The connecting cable 89 is connected to a screw 104, which connects a rotational bush 103 with the electrically conducting washer 105. The electric cable 78 and the connecting cable 89 are electrically connected by the mutual contact between the electrically conducting member 102 and the electrically conducting washer 105. The swivel piston 71 is electrically insulated by an insulating bush 108 and an insulating holder 109. A compression spring 110 is provided at the front end of the electrically conducting member 102 so as to urge the conducting member 102 toward the electrically conducting washer 105, ensuring the electrical contact therebetween. The reference numeral 111 shows silicon for sealing the inner region of the front rotational portion 100.

By this arrangement of the front rotational portion 100, an electrical current through the electric cable 78 flows from the electrically conducting member 102 through the electrically conducting washer 105 and the screw 104 to the connecting cable 89. Since the connecting cable 89 attached to the front rotational portion 100 is rotatable with respect to the electric cable 78 within the non-rotatable swivel piston 71, the electrical contact between the electric cable 78 and the connecting cable 89 is not cut off by the rotational movement of the attachment A This leads to reliable operational performance of the swivel joint.

Figure 10:
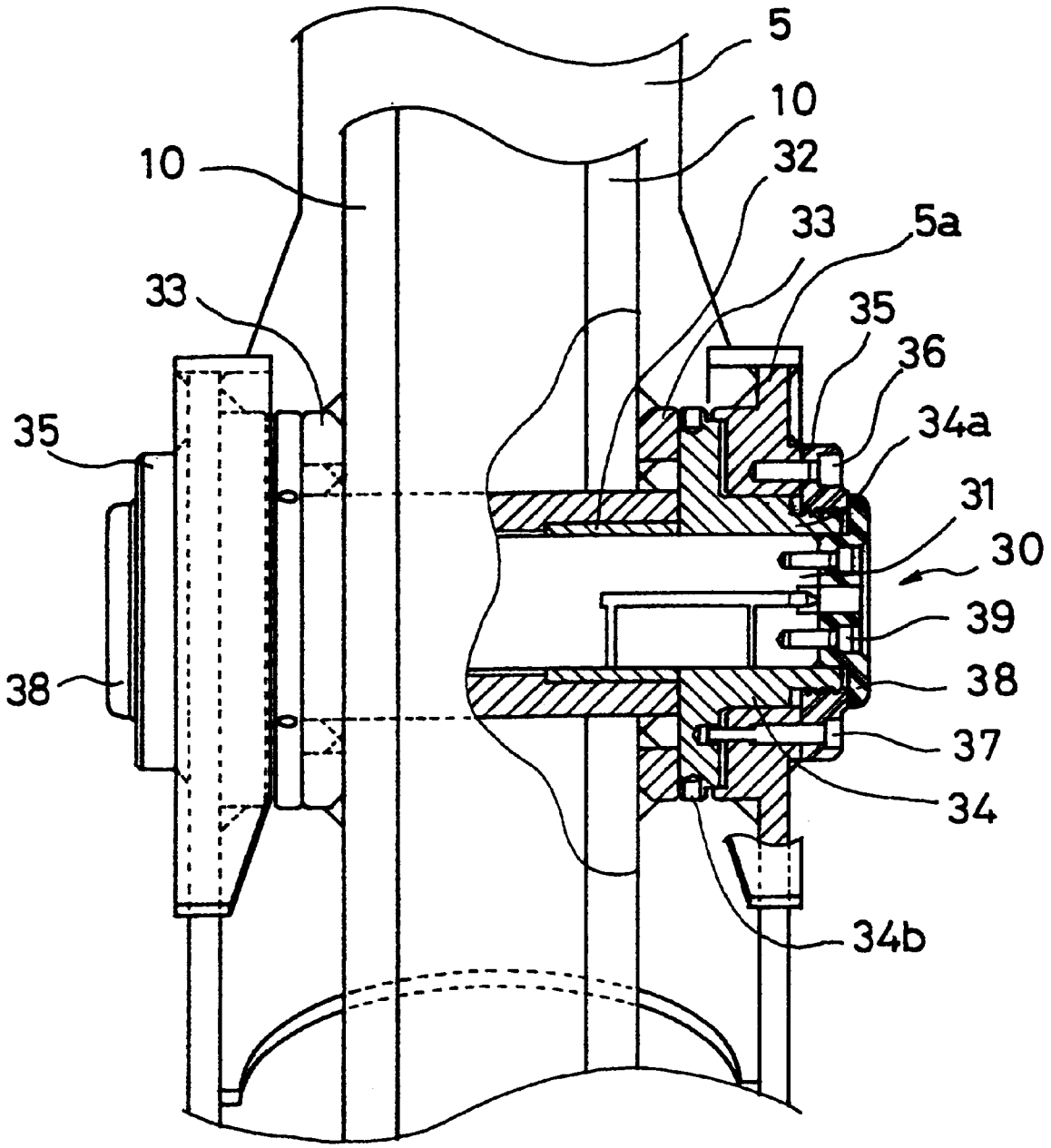
FIG. 10 is a plan view partially in cross section showing a position adjustment mechanism of the attachment of FIG. 1.
Figures 11A, 11B:
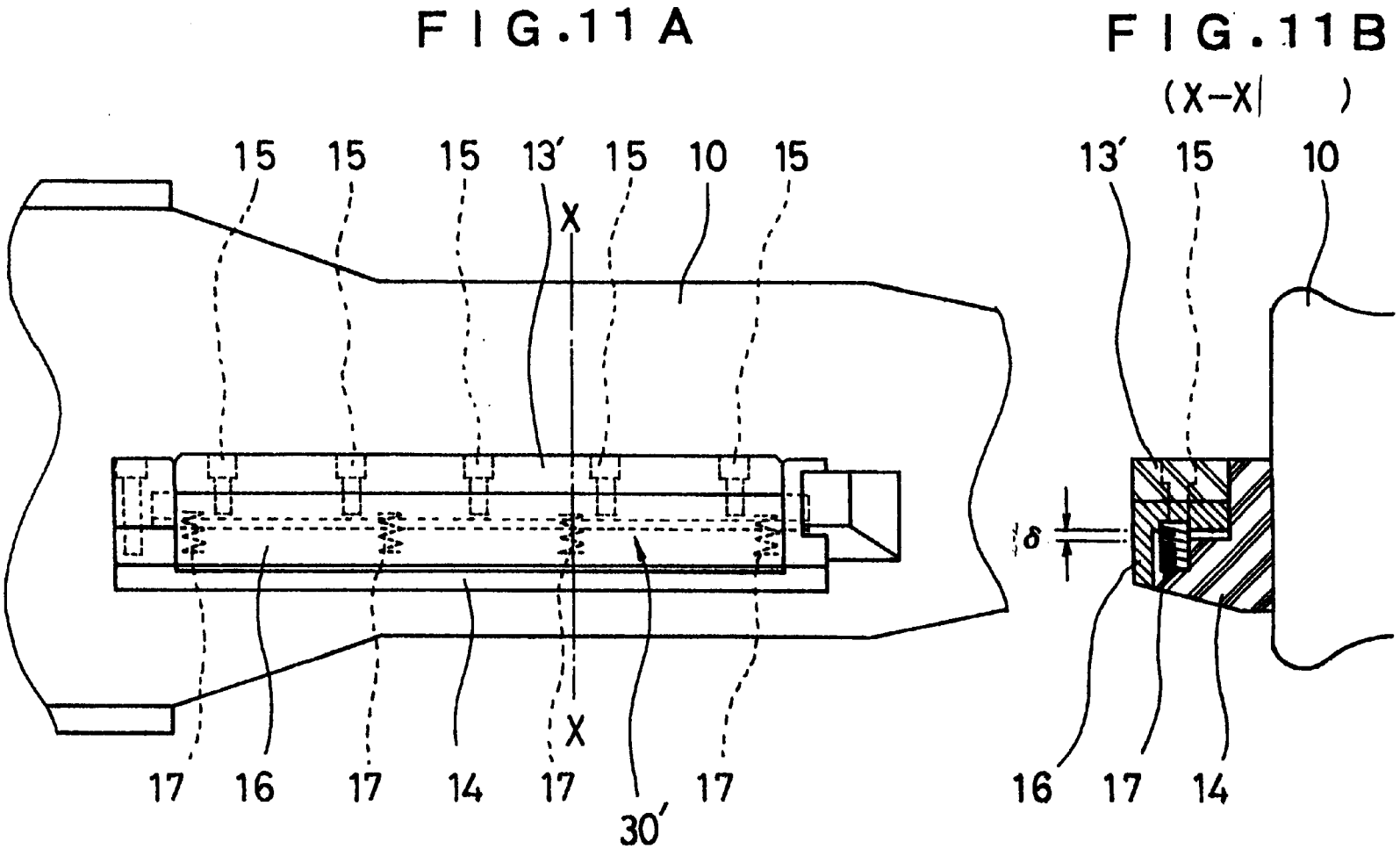
FIG. 11 shows a modified embodiment of the position adjustment mechanism, in which (a) is a plan view, and (b) is a sectional view taken along the line X—X.

As shown in FIG. 10, the movable member 10 is rotatably supported to the supporting axis 31 through a bush 32. A position adjustment mechanism 30 is provided for adjusting the axial position of the movable member 10 to the supporting axis 31. The position adjustment mechanism 30 is utilized for adjusting the relative position between the cutters 12, 22. The position adjustment mechanism 30 comprises a pair of thrust collars 34 in the form of ring, which are inserted over the supporting axis 31 so as to support the opposing ends 33, 33 of the movable member 10, a pair of collar adjustment portions 35, 35 each threadly engaging with the thread portion 34*a* of the thrust collar 34. The collar adjustment portions 35, 35 are fixed to the mounting portion 5*a* of the frame body 5 by a plurality of bolts 36, and they are also fixed to the thrust collars 34 by a plurality of bolts 37, thereby preventing rotation of the thrust collars 34. The supporting axis 31 is covered at its both ends with pin holders 38. The pin holders 38 are fixed to the supporting axis 31 by a plurality of bolts 39 so as to prevent the supporting axis 31 from being come off When adjusting the axial position of the movable member 10 to the supporting axis 31, the bolts 36, 37 are removed so that the thrust collar 34 can be rotatable. The thrust collar 34 is then rotated by a non-shown adjustment rod inserted into the adjustment aperture(s) 34*b* and is moved along the supporting axis 31 to a suitable cutter position. The removed bolts 36, 37 are again inserted, preventing the rotation of the thrust collar 34. Since the thrust collars 34 are positioned within the frame body 5, they are not subject to contact with outer objects, such as cuttings or soil FIG. 11 shows a modified embodiment of the position adjustment mechanism, in which the relative position of the cutters 12, 22 are automatically adjusted. The adjustment mechanism 30, comprises a slide table 16 to which is attached a cutting blade 13' and a plurality of coil springs 17 for retaining an appropriate gap δ. The slide table 16 is mounted on the cutter holder 14 of the movable member 10 by a plurality of bolts 15.

With the provision of the coil springs 17, the cutting blade 13' is urged toward the opposing cutting blade 23 of the stationary member 20 at an appropriate cushioning, leading to reduced abrasion of the cutting blade 13'. Further, if the cutting blade 13' is worn, it is automatically urged by the coil springs 17 so that the appropriate gap 6 is retained. Therefore, no complicated gap adjusting mechanism is required.

In this embodiment, a plurality of leaf springs may be employed in stead of the coil springs. Also, the position adjustment mechanism 30' may be provided at the stationary member 20.

Figure 12:
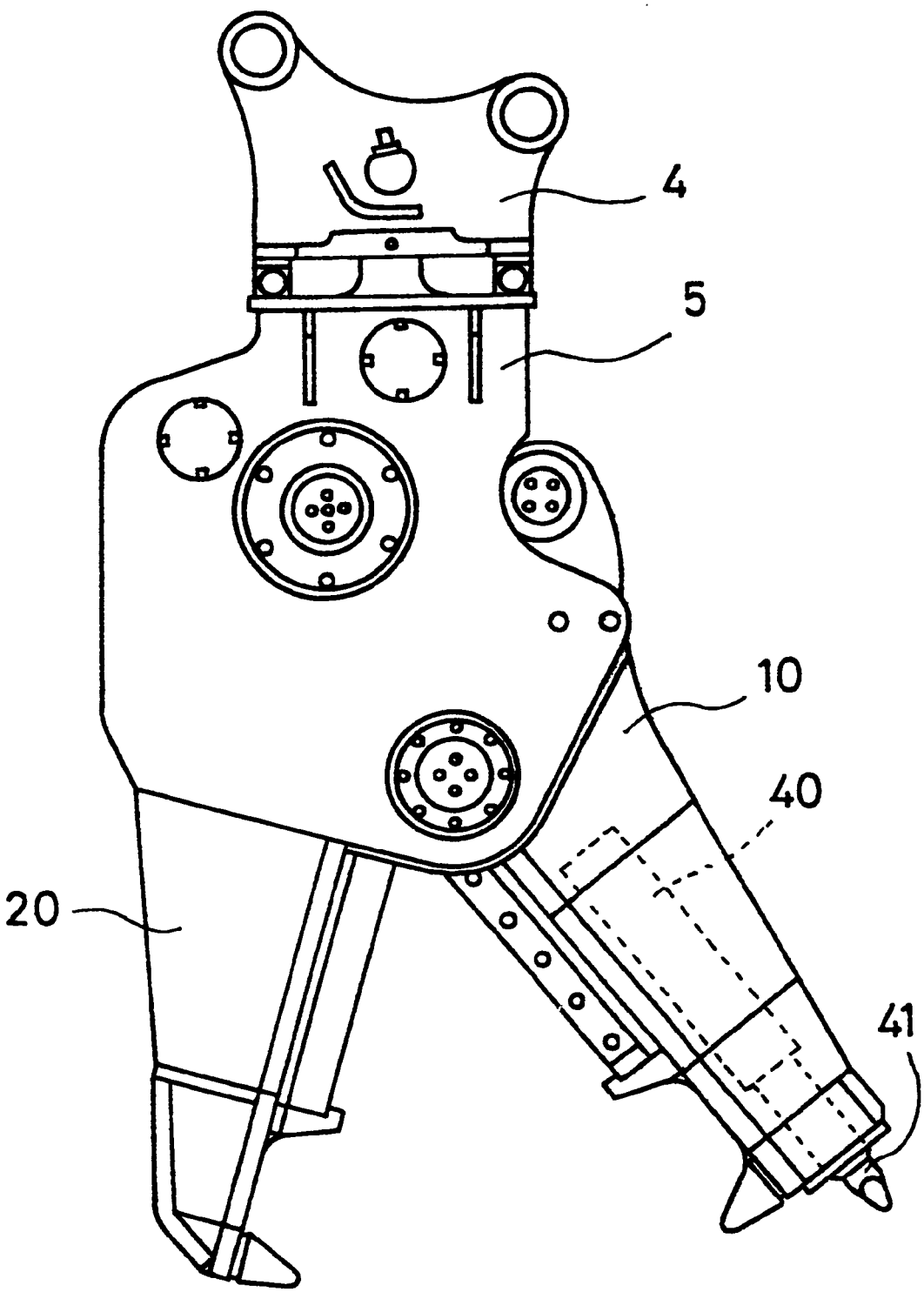
FIG. 12 is a side view showing modified embodiment of the attachment shown in FIG. 1.

Referring to FIG. 12, a modified embodiment of the attachment A is shown, in which the hydraulic breaker 40 is provided at the movable member 10. The chisel 41 is positioned at the front end of the movable member 20. With such arrangement, positioning of the hydraulic breaker 40 can be achieved merely by moving the movable member 10, enabling accurate and facilitated positioning operation of the hydraulic breaker 40. Since the positioning operation is achieved without requiring movement of the attachment itself, less hydraulic oil is necessary, which contributes to reduced operational cost.

Figure 13:
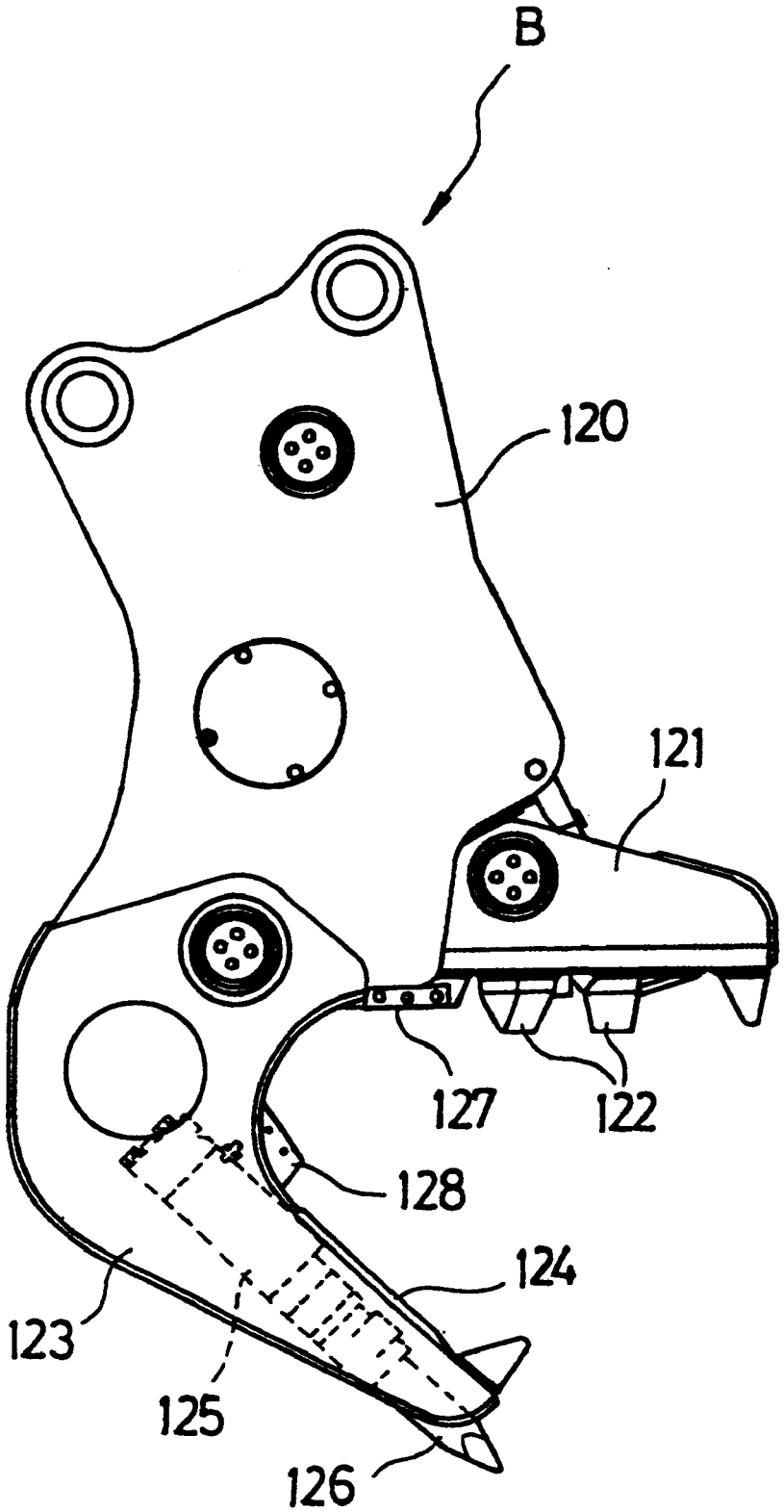
FIG. 13 is a side view showing another modified embodiment of the attachment shown in FIG. 1.

Another modified embodiment of the attachment A is shown in FIG. 13. The attachment B comprises a movable member 121 and a stationary member 123. The movable member 121 is provided with crushing teeth 122, while the stationary member 123 is provided with a receiving portion 124 for the crushing teeth 122. A hydraulic breaker 125 is provided within the stationary member 123 and the chisel 126 is positioned at the front end of the stationary member 123. The movable member 121 and the stationary member 123 are respectively provided at the inner end close to the supporting axis with a smaller cutter 127, 128. The attachment B facilitates a breaking operation of a concrete block into small cants by the use of the crushing teeth 122 as well as a cutting operation by the small cutters 127, 128. The hydraulic breaker 124 may of course be provided within the movable member 121.

Figure 14:
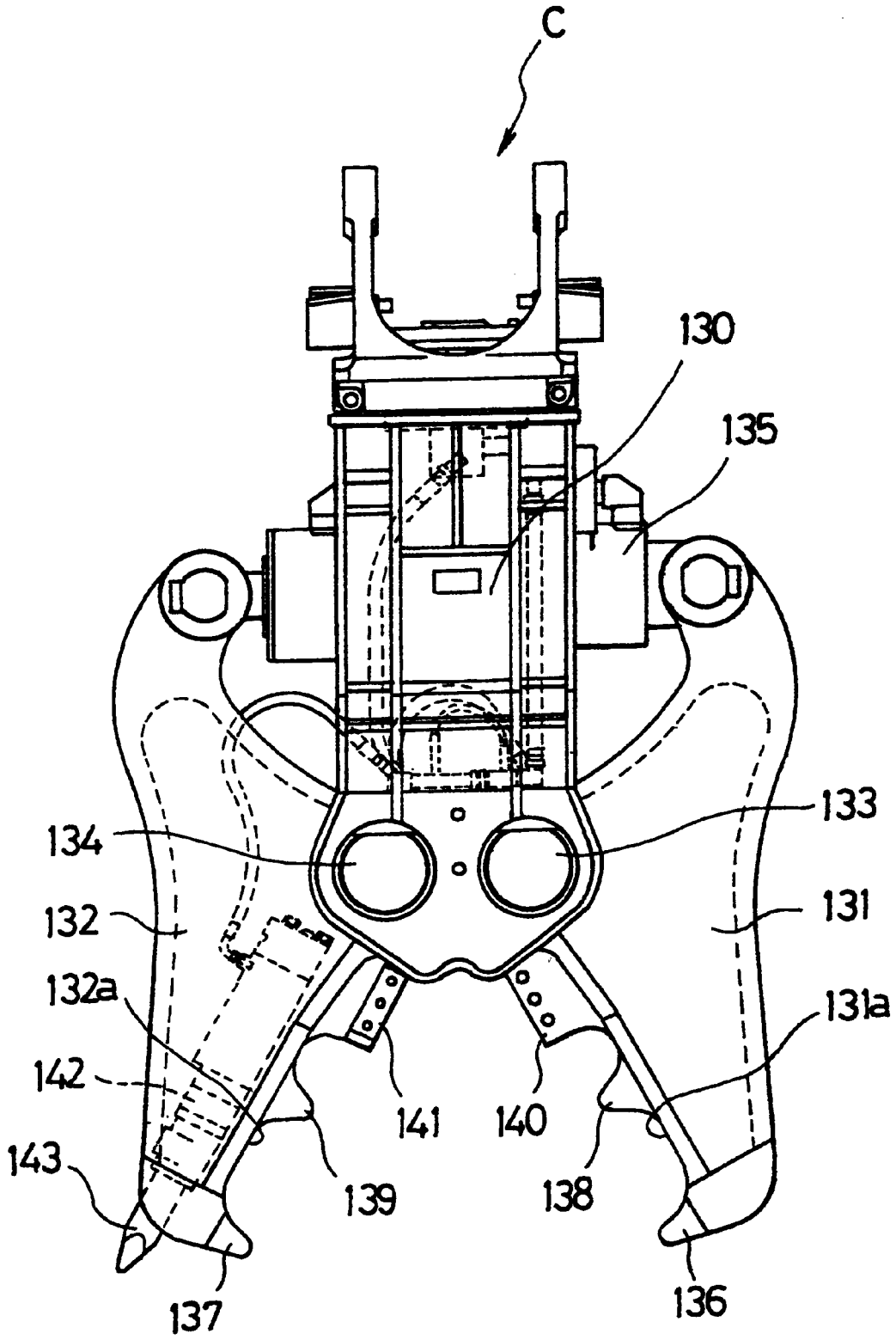
FIG. 14 is a side view showing still another modified embodiment of the attachment shown in FIG. 1.
Figure 15:
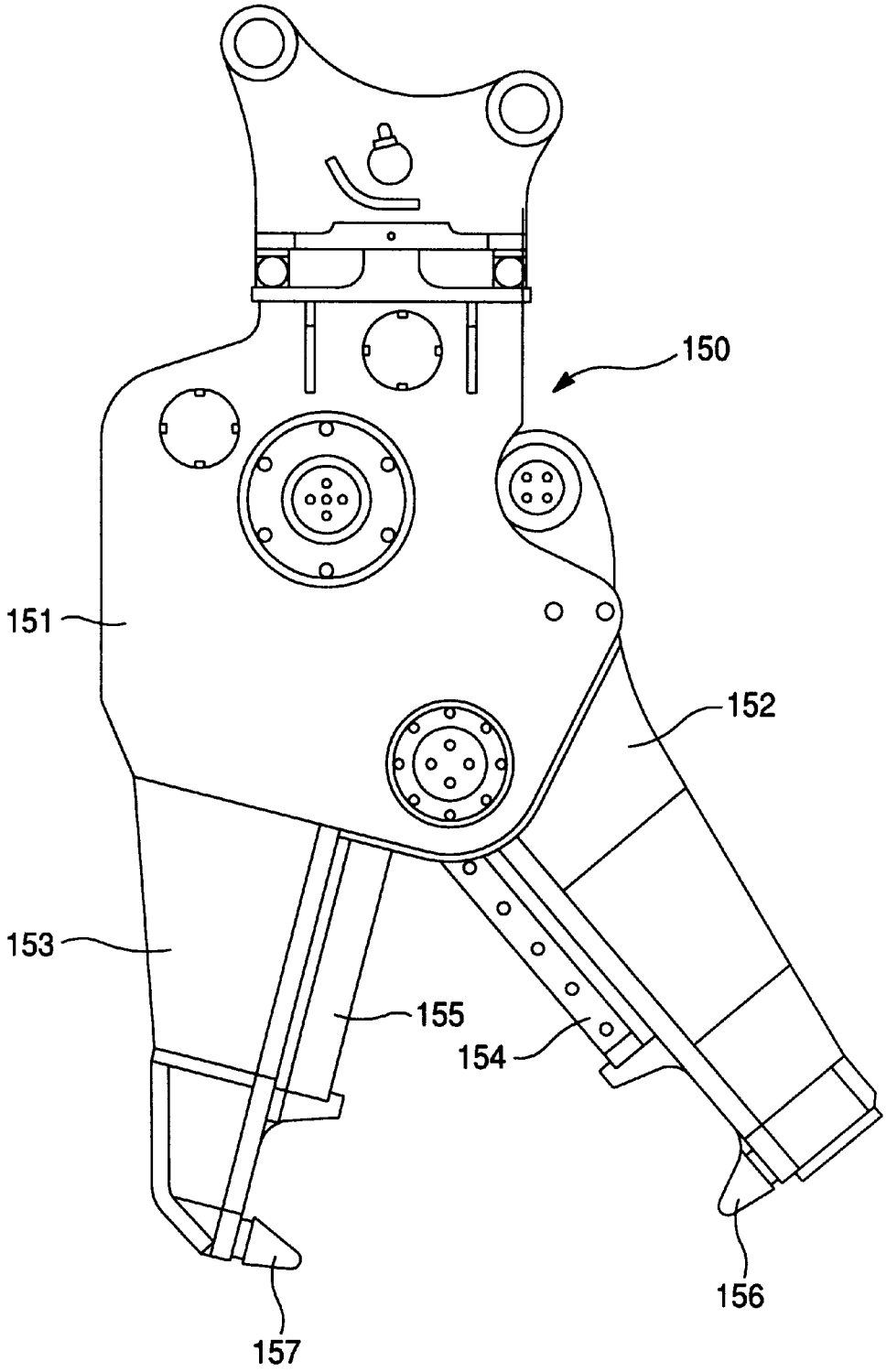
Fig. 15 Prior Art
FIG. 15 is a side view showing a conventional attachment for a construction machine.

Still another modified embodiment of the attachment A is shown in FIG. 14. The attachment C is utilized for breaking a concrete block into large cants. The attachment C comprises a pair of first and second movable members 131, 132, both of which are mounted on the frame body 130. Each movable member 131, 132 is connected at its base portion with a cylinder 135, while its central portion is rotatably supported by the supporting axis 133, 134. The movable members 131, 132 are relatively movable by the elongating or retracting movement of the cylinder 135. The opposing inner surfaces 131*a*, 132*a* of the movable members 131, 132 are respectively provided with a crushing claw 136, 137, a crushing teeth 138, 139 and a small cutter 140, 141. One of the movable members is farther provided with the hydraulic breaker 142 having the chisel 143.

With the provision of the two movable members 131, 132, the attachment C can be utilized for breaking larger concrete blocks. The attachment C can also be utilized for the cutting operation of reinforcing steels by the small cutters 140, 141 as well as for the drilling operation with the use of the hydraulic breaker 142. Another hydraulic breaker 142 may be provided at the other movable member According to the attachment of the present invention, a single attachment can be utilized for a various operations, such as drilling, cutting and breaking without requiting replacement of the work implements, leading to increased working efficiency.

What is claimed is:

1. An attachment for a construction machine including:

a top bracket adapted to be attached to an arm assembly of the construction machine;

a frame body;

first frame member attached to the frame body;

second frame member attached to the frame body in opposing relation with the first frame member;

cutting means mounted on respective opposing inner surfaces of the first and the second frame members;

crushing means provided on the first and the second frame members at respective front ends of the opposing inner surfaces, at least one of the first frame member and the second frame member being movable toward the other frame member for the engagement therewith;

a hydraulic breaker provided at the first frame member or the second frame member and having a chisel with a plurality of stepped portions;

a hydraulic power control unit for operating said movable frame member and the hydraulic breaker by hydraulic oil from a single hydraulic power unit; and a swivel joint rotatably connecting the top bracket and the frame body, the swivel joint including a front rotational portion rotatably connecting an electric cable and an connecting cable through an electrically conducting bearing.

2. An attachment according to claim 1, wherein said first frame member is a stationary member fixed to the frame body and said second frame member is a movable member rotatably supported to the frame body, and said hydraulic breaker is provided within the second frame member.

3. An attachment according to claim 2, wherein a position adjustment mechanism is provided for adjusting a relative position of the cutter means provided on said first and second frame members, the position adjustment mechanism being provided at a supporting axis rotatably supporting said second frame member and including a thrust collar inserted over the supporting axis so as to adjust the axial position of said second frame member to the supporting axis.

4. An attachment according to claim 2, wherein a position adjustment mechanism is provided for adjusting a relative position of the cutter means provided on said first and second frame members, said position adjusting mechanism including a cutter holder fixed to said first or second frame member and the cutter mounted on the cutter holder through spring means.

5. An attachment according to claim 2, wherein said second frame member is provided with crushing teeth in place of the cutting means and, said first frame member is provided with a receiving portion for the cutting teeth or other corresponding crushing teeth in place of the cutting means.

6. An attachment for a construction machine including:

a top bracket adapted to be attached to an arm assembly of the construction machine;

a frame body;

a first frame member attached to the frame body;

a second frame member attached to the frame body in opposing relation with the first frame member;

cutting means mounted on respective opposing inner surfaces of the first and the second frame members;

crushing means provided on the first and the second frame members at respective front ends of the opposing inner surfaces, at least one of the first frame member and the second frame member being movable toward the other frame member for the engagement therewith;

a hydraulic breaker provided at the first frame member or the second frame member and having a chisel with a plurality of stepped portions;

a hydraulic power control unit for operating said movable frame member and the hydraulic breaker by hydraulic oil from a single hydraulic power unit; and a swivel joint rotatably connecting the top bracket and the frame body, the swivel joint including a front rotational portion rotatably connecting an electrically conducting member provided at the front end of an electric cable and an electrically conducting washer mounted at the front end of a connecting cable.

7. An attachment according to claim 6, wherein said first frame member is a stationary member fixed to the frame body and said second frame member is a movable member rotatably supported to the frame body, and said hydraulic breaker is provided within the second frame member.

8. An attachment according to claim 7, wherein a position adjustment mechanism is provided for adjusting a relative position of the cutter means provided on said first and second frame members, the position adjustment mechanism being provided at a supporting axis rotatably supporting said second frame member and including a thrust collar inserted over the supporting axis so as to adjust the axial position of said second frame member to the supporting axis.

9. An attachment according to claim 7, wherein a position adjustment mechanism is provided for adjusting a relative position of the cutter means provided on said first and second frame members, said position adjusting mechanism including a cutter holder fixed to said first or second frame member and the cutter mounted on the cutter holder through spring means.

10. An attachment according to claim 7, wherein said second frame member is provided with crushing teeth in place of the cutting means and said first frame member is provided with a receiving portion for cutting teeth or other corresponding crushing teeth in place of the cutting means.

11. An attachment for a construction machine including:

a top bracket adapted to be attached to an arm assembly of the construction machine;

a frame body;

a first frame member attached to the frame body;

a second frame member attached to the frame body in opposing relation with the first frame member;

cutting means mounted on respective opposing inner surfaces of the first and the second frame members;

crushing means provided on the first and the second frame members at respective front ends of the opposing inner surfaces, at least one of the first frame member and the second frame member being movable toward the other frame member for the engagement therewith;

a hydraulic breaker provided at the first frame member or the second frame member and having a chisel;

at least two stepped portions provided at a front portion and a base portion of said chisel; and bushing means provided within said frame member having said hydraulic breaker so as to support said stepped portions.

12. An attachment according to claim 11, wherein a hydraulic power control unit is provided for operating said movable frame member and the hydraulic breaker by hydraulic oil from a single hydraulic power unit, the hydraulic power control unit including a priority valve.

13. An attachment for a construction machine including:

a top bracket adapted to be attached to an arm assembly of the construction machine;

a frame body;

a first frame member attached to the frame body;

a second frame member attached to the frame body in opposing relation with the first frame member;

cutting means mounted on respective opposing inner surfaces of the first and the second frame members;

crushing means provided on the first and the second frame members at respective front ends of the opposing inner surfaces, at least one of the first frame member and the second frame member being movable toward the other frame member for the engagement therewith;

a hydraulic breaker provided at the first frame member or the second frame member and having a chisel; and a hydraulic power control unit for operating said movable frame member and the hydraulic breaker by hydraulic oil from a single hydraulic power unit, the hydraulic power control unit including a priority valve.

14. An attachment for a construction machine including:

a top bracket adapted to be attached to an arm assembly of the construction machine;

a frame body;

a first frame member attached to the frame body;

a second frame member attached to the frame body in opposing relation with the first frame member;

cutting means mounted on respective opposing inner surfaces of the first and the second frame members;

crushing means provided on the first and the second frame members respective front ends of the opposing inner surfaces, at least one of the first frame member and the second frame member being movable toward the other frame member for the engagement therewith;

a hydraulic breaker provided at the first frame member or the second frame member and having a chisel with a plurality of stepped portions; and a position adjustment mechanism for adjusting a relative position of the cutter means provided on said first and second frame members, the position adjustment mechanism being provided at a supporting axis rotatably supporting said second frame member and including a thrust collar inserted over the supporting axis so as to adjust the axial position of said second frame member to the supporting axis.

15. An attachment for a construction machine including:

a top bracket adapted to be attached to an arm assembly of the construction machine;

a frame body;

a first frame member attached to the frame body;

a second frame member attached to the frame body in opposing relation with the first frame member;

cutting means mounted on respective opposing inner surfaces of the first and the second frame members;

crushing means provided on the first and the second frame members at respective front ends of the opposing inner surfaces, at least one of the first frame member and the second frame member being movable toward the other frame member for the engagement therewith;

a hydraulic breaker provided at the first frame member or the second frame member and having a chisel with a plurality of stepped portions; and a position adjustment mechanism for adjusting a relative position of the cutter means provided on said first and second frame members, said position adjusting mechanism including a cutter holder fixed to said first or second frame member and the cutter mounted on the cutter holder through spring means.

* * * * *